US005116571A

United States Patent [19]

Abe et al.

[11] Patent Number: 5,116,571

[45] Date of Patent: May 26, 1992

[54] CHROMOUM HEAT-RESISTANT STEEL EXCELLENT IN TOUGHNESS AND HAVING HIGH CRACKING RESISTANCE AND HIGH CREEP STRENGTH IN WELDED JOINT

[75] Inventors: Nakatsugu Abe, Yokohama; Haruo Suzuki, Chigasaki; Hiroaki Tsukamoto, Yokohama; Seishi Tsuyama, Fukuyama; Moriyasu Nagae, Yokohama, all of Japan

[73] Assignee: Nippon Kokan Kabushiki Kaisha, Tokyo, Japan

[21] Appl. No.: 730,013

[22] Filed: Jul. 12, 1991

Related U.S. Application Data

[63] Continuation of Ser. No. 600,157, Oct. 17, 1990, abandoned, which is a continuation of Ser. No. 442,493, Nov. 27, 1989, abandoned, which is a continuation of Ser. No. 309,047, Feb. 9, 1989, abandoned, which is a continuation of Ser. No. 207,025, Jun. 13, 1988, abandoned, which is a continuation of Ser. No. 883,066, Jul. 8, 1986, abandoned.

[30] Foreign Application Priority Data

Jul. 25, 1985 [JP] Japan ..... 60-162914
May 20, 1986 [JP] Japan ..... 61-113441

[51] Int. Cl.[5] ..... C22C 38/22; C22C 38/26

[52] U.S. Cl. ..... 420/110; 420/111; 420/109; 420/69

[58] Field of Search ..... 420/110, 111, 109, 69

[56] References Cited

U.S. PATENT DOCUMENTS

| | | | |
|---|---|---|---|
| 2,121,001 | 6/1938 | Arness | 420/34 |
| 2,905,577 | 9/1959 | Harris et al. | 148/325 |
| 3,044,872 | 7/1962 | Hayes et al. | 420/110 |
| 4,405,369 | 9/1983 | Otoguro et al. | 420/40 |

FOREIGN PATENT DOCUMENTS

| | | | |
|---|---|---|---|
| 58-110662 | 7/1983 | Japan | 420/69 |
| 60-29449 | 2/1985 | Japan | 420/106 |
| 795471 | 5/1958 | United Kingdom . | |
| 921838 | 3/1963 | United Kingdom . | |
| 1189347 | 4/1970 | United Kingdom . | |
| 2075549 | 11/1981 | United Kingdom . | |

*Primary Examiner*—Deborah Yee
*Attorney, Agent, or Firm*—Frishauf, Holtz, Goodman & Woodward

[57] ABSTRACT

A chromium heat-resistant steel excellent in toughness and having a high cracking resistance and a high creep strength when said steel is utilized to form a welded joint, said steel consisting essentially of:

| | |
|---|---|
| carbon: | from 0.04 to 0.09 wt. %, |
| silicon: | from 0.01 to 0.50 wt. %, |
| manganese: | from 0.25 to 1.50 wt. %, |
| chromium: | from 7.0 to 9.2 wt. %, |
| molybdenum: | from 0.50 to 1.50 wt. %, |
| soluble aluminum: | from 0.005 to 0.060 wt. %, |
| nitrogen: | from 0.001 to 0.060 wt. %, |

where, the total amount of nitrogen and carbon being up to 0.13 wt. %, at least one element selected from the group consisting of:

| | |
|---|---|
| vanadium: | from 0.01 to 0.30 wt. %, |
| and | |
| niobium: | from 0.005 to 0.200 wt. %, |

where, the total amount of vanadium and 1.5 times niobium being up to 0.30 wt. %, and the balance being iron and incidental impurities; and the amount of ferrite as represented by the ferrite number ($\delta_F$) in the above-mentioned chromium heat-resistant steel being −5 or lower, as calculated by the following formula:

$$\delta_F = -104 - 555(C + 6/7.N) - 32.9Si - 49.5Mn - 12.1Cr + 39.1Mo + 46.1V - 83.5Nb.$$

11 Claims, 4 Drawing Sheets

CHROMOUM HEAT-RESISTANT STEEL EXCELLENT IN TOUGHNESS AND HAVING HIGH CRACKING RESISTANCE AND HIGH CREEP STRENGTH IN WELDED JOINT

This application is a continuation of application Ser. No. 07/600.157 filed Oct. 17, 1990 (abandoned); which is a continuation of application Ser. No. 07/442,493 filed Nov. 27, 1989 (abandoned); which is a continuation of application Ser. No. 07/309,047 filed Feb. 9, 1989 (abandoned); which is a continuation of application Ser. No. 07/207/025 filed June 13, 1988 (abandoned); which is a continuation of application Ser. No. 06/883,066 filed Jul. 8, 1986 (abandoned).

FIELD OF THE INVENTION

The present invention relates to a chromium heat-resistant steel excellent in toughness and having a high cracking resistance and a high creep strength when said steel is utilized to form a welded joint.

BACKGROUND OF THE INVENTION

Construction of nuclear power plants is now positively promoted to meet the rapidly increasing demand for electric power. Most of the nuclear reactors in the nuclear power plants in operation at present are light-water reactors using as fuels uranium-235 which is contained in natural uranium in an among of only 0.7 wt.%. The amount of natural uranium deposits is estimated to be only about five million tons in the whole world. There is therefore a strong demand for the full industrialization of a nuclear power plant based on a fast breeder reactor which permits effective use of natural uranium of which the amount of deposits is limited as mentioned above.

A fast breeder reactor has the following advantages: The fast breeder reactor uses as fuels plutonium-239 and uranium-238 contained in large quantities in natural uranium. Nuclear fission of plutonium-239 is caused by fast neutrons, and this nuclear fission produces thermal energy. A fraction of fast neutrons produced through nuclear fission is absorbed into uranium-238 and converts uranium-238 into plutonium-239. As a result, converted plutonium-239 in an amount of over that of plutonium-239 consumed through nuclear fission is produced in the fast breeder reactor. With the fast breeder reactor, therefore, it is possible to produce thermal energy through nuclear fission of plutonium-239 over a long period of time without replenishing the fuels.

However, a nuclear power plant based on the fast breeder reactor requires a construction cost more than twice as high as that for a nuclear power plant based on the light-water reactor. Therefore, in order to achieve the full industrialization of the nuclear power plant based on the fast breeder reactor, reduction of the construction cost is essential.

The nuclear power plant based on the fast breeder reactor comprises a fast breeder reactor, a steam generator and an electric power generator. Thermal energy produced through nuclear fission of plutonium-239 as described above in the fast breeder reactor, heats liquid sodium as a coolant flowing through the fast breeder reactor to a high temperature. The thus heated high-temperature liquid sodium is introduced into the steam generator comprising a superheater and an evaporator, and heats high-pressure water flowing through the superheater and the evaporator through heat exchange.

As a result, the high-pressure water flowing through the superheater and the evaporator becomes superheated steam. The thus produced superheated steam is fed to a turbine of the electric power generator to drive the turbine. Driving of the turbine causes electric power generation.

The superheater comprises a vessel, and heat exchanger tubes and tube sheets provided in the vessel. The temperature cf the superheater is increased to about 550° C. by the superheated steam flowing through the heat exchanger tubes. Therefore, it is the conventional practice to use SUS304 austenitic stainless steel specified in JIS (Japanese Industrial Standards) as the material for the vessel of the superheater and to use SUS321 austenitic stainless steel specified in JIS as the material for the heat exchanger tubes and the tube sheets of the superheater.

The evaporator also comprises a vessel, and heat exchanger tubes and tube sheets provided in the vessel. The temperature of the evaporator is lower than that of the superheater. It is therefore the conventional practice to use 2¼Cr-1Mo steel as the material for the vessel, the heat exchanger tubes and the tube sheets of the evaporator.

The conventional use of expensive austenitic stainless steel as the material for the superheater causes the high construction cost of a nuclear power plant. Furthermore, the material for the superheater is different from that for the evaporator as described above. When connecting the superheater together with the evaporator by welding, therefore, the following problem is caused in the resulting welded joint: The carbon content of austenitic stainless steel which is the material for the superheater is lower than the carbon content of 2¼Cr-1Mo steel which is the material for the evaporator. The carbon activity of austenitic stainless steel in liquid sodium flowing through the superheater and the evaporator is different from that of 2¼Cr-1Mo steel. Consequently, decarburization occurs on the 2¼Cr-1Mo steel side in the welded joint during service and cementation, i.e., carburization takes place on the austenitic stainless steel side in the welded joint, thus resulting in deterioration of the welded joint.

With a view to solving the above-mentioned problems, a low-cost heat-resistant steel having a creep strength comparable with that of the above-mentioned austenitic stainless steel is required as the material common to the superheater and the evaporator. As a heat-resistant steel meeting such a requirement, ASTM (American Society for Testing and Materials) Standards specify a 9% chromium heat-resistant steel (A213-T91) having the chemical composition as shown in Table 1.

TABLE 1

| C | Si | Mn | P | S | Cr | Mo | V | Nb |
|---|---|---|---|---|---|---|---|---|
| 0.10 | 0.39 | 0.38 | 0.002 | 0.006 | 8.30 | 0.93 | 0.21 | 0.08 |

However, the 9% chromium heat-resistant steel (A213-T91) having the chemical composition shown in Table 1 has the following problems: The carbon content is so high as 0.10 wt.%. Low-temperature cracking resistance in the welded joint is therefore low, and the production of $\alpha+\gamma$ phase upon solidification of molten metal during welding results in a low high-temperature cracking resistance in the welded joint. In addition, since creep strength of the base metal becomes excessively high, there occurs a large difference in creep strength between the softened zone of the welded joint and the base metal, thus resulting in deterioration of the welded joint.

As a low-cost heat-resistant steel having a creep strength comparable with that of the above-mentioned austenitic stainless steel, JIS specifies a 9% chromium heat-resistant steel (STBA-27) having the chemical composition shown in Table 2 (although not as yet officially instituted).

TABLE 2

| C | Si | Mn | P | S | Cr | Mo |
|---|---|---|---|---|---|---|
| 0.05 | 0.46 | 0.55 | 0.002 | 0.007 | 8.47 | 2.00 |

However, the 9% chromium heat-resistant steel (STBA-27) having the chemical composition shown in Table 2 has the following problems: The molybdenum content is so high as 2.00 wt.%. This causes an increase in the amount of ferrite in the steel, thus resulting in low toughness. In addition, when heated for a long period of time during service, precipitation of a Laves phase ($Fe_2Mo$) leads to a further deterioration of toughness.

The nuclear power plant based on the fast breeder reactor requires a high construction cost as described above. Therefore, in order to cover the huge construction cost and to reduce the electric power generation cost to below that of an electric power plant using coal, petroleum or liquefied natural gas as the fuel, it is necessary to increase the operating rate of the plant without the occurrence of accidents.

Under such circumstances, there is a strong demand for the development of a low-cost chromium heat-resistant steel which is excellent in toughness and has a high cracking resistance and a high creep strength when said steel is utilized to form a welded joint, and which is particularly suitable for use as the material for a steam generator of a nuclear power plant based on a fast breeder reactor, but such a heat-resistant steel has not as yet been proposed.

SUMMARY OF THE INVENTION

An object of the present invention is therefore to provide a chromium heat-resistant steel excellent in toughness and having a high cracking resistance and a high creep strength when said steel is utilized to form a welded joint.

Another object of the present invention is to provide a low-cost chromium heat-resistant steel suitable for use as the material for a steam generator of a nuclear power plant based on a fast breeder reactor.

In accordance with one of the features of the present invention, there is provided a chromium heat-resistant steel excellent in toughness and having a high cracking resistance and a high creep strength when said steel is utilized to form a welded joint, characterized by consisting essentially of:

| | |
|---|---|
| carbon: | from 0.04 to 0.09 wt. %, |
| silicon: | from 0.01 to 0.50 wt. %, |
| manganese: | from 0.25 to 1.50 wt. %, |
| chromium: | from 7.0 to 9.2 wt. %, |
| molybdenum: | from 0.50 to 1.50 wt. %, |
| soluble aluminum: | from 0.005 to 0.060 wt. %, |
| nitrogen: | from 0.001 to 0.060 wt. %, |

where, the total amount of said nitrogen and said carbon being up to 0.13 wt.%, at least one element selected from the group consisting of:

| | |
|---|---|
| vanadium: | from 0.01 to 0.30 wt. %, |
| and | |
| niobium: | from 0.005 to 0.200 wt. %, |

where, the total amount of said vanadium and 1.5 times said niobium being up to 0.30 wt.%, and the balance being iron and incidental impurities; and the amount of ferrite ($\delta_F$) represented by the ferrite number in said chromium heat-resistant steel being −5 or lower, as calculated by the following formula:

$$\delta_F = -104 - 555\,(C + 6/7N) + 32.9Si - 49.5\,Mn + 12.1Cr + 39.1Mo + 46.1V + 83.5Nb.$$

DETAILED DESCRIPTION OF PREFERRED EMBODIMENTS

Figure 1:
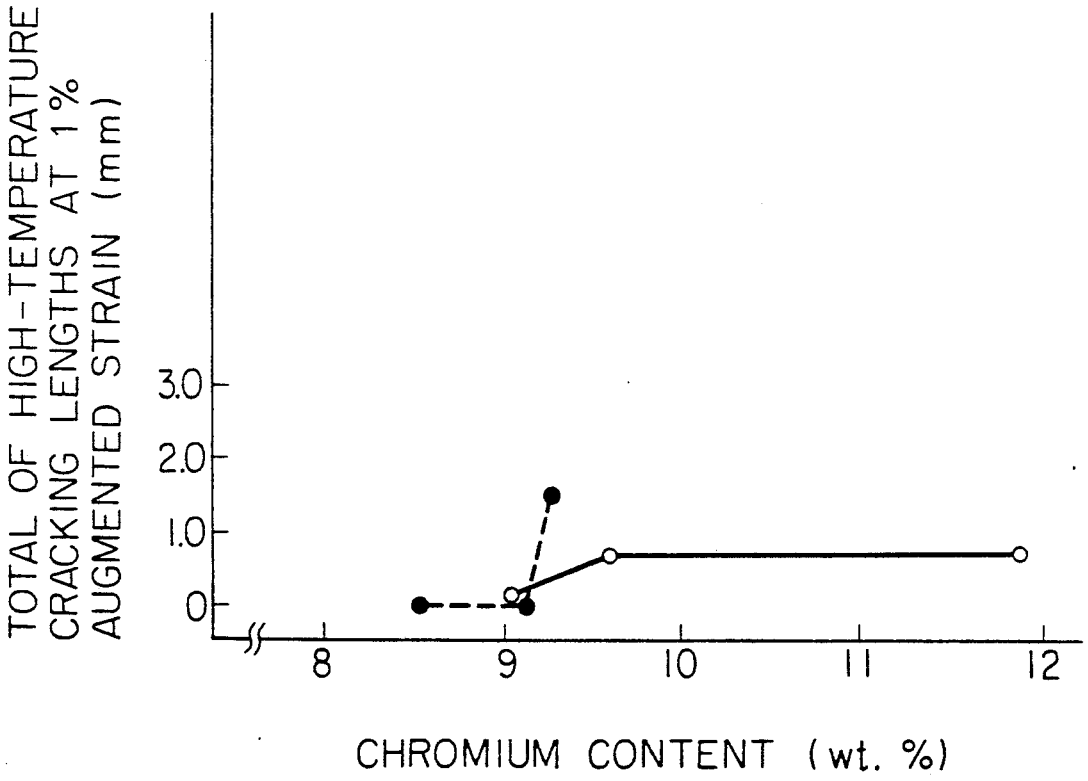
FIG. 1 is a graph illustrating the effect of the chromium content on high-temperature cracking resistance in a welded joint.

From the above-mentioned point of view, extensive studies were carried out to develop a low-cost chromium heat-resistant steel which is excellent in toughness and has a high cracking resistance and a high creep strength when said steel is utilized to form a welded joint, and which is particularly suitable for use as the material for a steam generator of a nuclear power plant based on a fast breeder reactor. As a result, the following findings were obtained:

(1) It is possible to improve toughness and increase creep strength in a welded joint without impairing cracking resistance in the welded joint by limiting the carbon content within the range of from 0.04 to 0.09 wt.%.

(2) It is possible to improve creep strength in the welded joint without reducing toughness by limiting the molybdenum content within the range of from 0.50 to 1.50 wt.%.

(3) It is possible to improve creep strength in the welded joint without impairing high-temperature cracking resistance by adding at least one of from 0.01 to 0.30 wt.% vanadium and from 0.005 to 0.200 wt.% niobium so that the total amount of vanadium and 1.5 times niobium is up to 0.30 wt.%.

(4) It is possible to prevent deterioration of toughness by limiting the amount of ferrite ($\delta_F$) in a chromium heat-resistant steel to a ferrite number of 5 or lower, as calculated by the following formula:

$$\delta_F = -104 - 555\,(C + 6/7N) + 32.9Si - 49.5Mn + 12.1Cr + 39.1Mo + 46.1V + 8.35Nb.$$

The present invention was made on the basis of the above-mentioned findings, and the chromium heat-resistant steel of the present invention is characterized by a chemical composition consisting essentially of:

| | |
|---|---|
| carbon: | from 0.04 to 0.09 wt. %, |
| silicon: | from 0.01 to 0.50 wt. %, |
| manganese: | from 0.25 to 1.50 wt. %, |
| chromium: | from 7.0 to 9.2 wt. %, |
| molybdenum: | from 0.50 to 1.50 wt. %, |
| soluble aluminum: | from 0.005 to 0.060 wt. %, |
| nitrogen: | from 0.001 to 0.060 wt. %, |

where, the total amount of said nitrogen and said carbon being up to 0.13 wt.%, at least one element selected from the group consisting of:

| | |
|---|---|
| vanadium: | from 0.01 to 0.30 wt. %, |
| and | |
| niobium: | from 0.005 to 0.200 wt. %, |

where, the total amount of said vanadium and 1.5 times said niobium being up to 0.30 wt.%, and the balance being iron and incidental impurities; and the amount of ferrite as represented by the ferrite number ($\delta_F$) in said chromium heat-resistant steel being −5 on lower, as calculated by the following formula:

$$\delta_F = -104 - 555(C - 6/7N) + 32.9Si - 49.5Mn + 12.1Cr + 39.1Mo + 46.1V + 83.5Nb.$$

The reasons why the chemical composition of and the amount of ferrite ($\delta_F$) in the chromium heat-resistant steel of the present invention are limited within the ranges as mentioned above are described below.

(1) Carbon

Carbon has the function of improving creep strength by producing carbides through combination with chromium, molybdenum, vanadium and niobium, and improving toughness by reducing the amount of ferrite in the steel. However, with a carbon content of under 0.04 wt.%, the desired effect as mentioned above cannot be obtained. With a carbon content of over 0.09 wt.%, on the other hand, low-temperature cracking resistance and high-temperature cracking resistance in the welded joint are deteriorated. Therefore, the carbon content should be limited within the range of from 0.04 to 0.09 wt.%.

(2) Silicon

Silicon has a deoxidizing effect and the function of improving hardenability. However, with a silicon content of under 0.01 wt.%, the desired effect as mentioned above cannot be obtained. With a silicon content of over 0.50 wt.%, on the other hand, the amount of ferrite in the steel increases, thus leading to a lower toughness. Therefore, the silicon content should be limited within the range of from 0.01 to 0.50 wt.%.

(3) Manganese

Manganese has a deoxidizing effect and the function of improving hardenability and strength. However, with a manganese content of under 0.25 wt.%, the desired effect as mentioned above cannot be obtained. With a manganese content of over 1.50 wt.%, on the other hand, the steel becomes excessively hard, and low-temperature cracking resistance in the welded joint is deteriorated. Therefore, the manganese content should be limited within the range of from 0.25 to 1.50 wt.%.

(4) Chromium

Chromium has the function of improving oxidation resistance. However, with a chromium content of under 7.0 wt.%, the desired effect as mentioned above cannot be obtained With a chromium content of over 9.2 wt.%, on the other hand, high-temperature cracking resistance in the welded joint is deteriorated, and the amount of ferrite in the steel increases, thus resulting in a deteriorated toughness.

We investigated the effect of the chromium content on high-temperature cracking resistance in the welded joint in accordance with the trans-varestraint test as described hereafter. The surfaces of test pieces each having a prescribed thickness were partly welded. The welded joints of the test pieces during welding were forcedly bent under a 1% augmented strain, and the total of hightemperature crack lengths produced in each of the welded joints was measured. The result of this test is illustrated in FIG. 1. In FIG. 1, plots "O" represent the total of high-temperature crack lengths of the chromium steel test pieces which have the chromium contents different from each other and contain 0.24 wt.% vanadium and 0.11 wt.% niobium; and plots "●" represent the total of high-temperature crack lengths of the chromium steel test pieces which have the different chromium contents and contain 0.17 wt.% vanadium and 0.22 wt.% niobium. As is clear from FIG. 1, a chromium content of over 9.2 wt.% leads to a larger total of high-temperature crack lengths and a lower high-temperature cracking resistance in the welded joint. Therefore, the chromium content should be limited within the range of from 7.0 to 9.2 wt.%.

(5) Molybdenum

Molybdenum has the function of increasing creep strength in the welded joint. However, with a molybdenum content of under 0.50 wt.%, the desired effect as mentioned above cannot be obtained. With a molybdenum content of over 1.50 wt.%, on the other hand, the increased amount of ferrite in steel deteriorates toughness, and when heated for a long period of time during service, precipitation of a Laves phase ($Fe_2Mo$) further degrades toughness. Therefore, the molybdenum content should be limited within the range of from 0.50 to 1.50 wt.%.

(6) Soluble aluminum

Soluble aluminum has the function of improving toughness by preventing austenitic grains from coarsening, and when boron described later is added, of increasing the hardenability improving effect of boron. However, with a soluble aluminum content of under 0.005 wt.%, the desired effect as mentioned above cannot be obtained. With a soluble aluminum content of over 0.060 wt.%, on the other hand, the increased amount of ferrite in steel deteriorates toughness. Therefore, the soluble aluminum content should be limited within the range of from 0.005 to 0.060 wt.%.

(7) Nitrogen

Nitrogen has the function of reducing the amount of ferrite in steel, and thus improving toughness. However, with a nitrogen content of under 0.001 wt.%, the desired effect as mentioned above cannot be obtained.

With a nitrogen content of over 0.060 wt.%, on the other hand, hardenability increases excessively. Therefore, the nitrogen content should be limited within the range of from 0.001 to 0.060 wt.%. With a total amount of nitrogen and carbon of over 0.13 wt.%, low-temperature cracking resistance and high-temperature cracking resistance in the welded joint are deteriorated. Therefore, the total amount of nitrogen and carbon should be limited up to 0.13 wt.%.

(8) Vanadium

Vanadium has the function of producing carbide through combination with carbon, and thus improving creep strength. However, with a vanadium content of under 0.01 wt.%, the desired effect as mentioned above cannot be obtained. With a vanadium content of over 0.30 wt.%, on the other hand, it is necessary to increase the heat treatment temperature when applying a heat treatment to dissolve carbide produced through combination with carbon, and the increased amount of ferrite in steel deteriorates not only toughness but also high-temperature cracking resistance in the welded joint. Therefore, the vanadium content should be limited within the range of from 0.01 to 0.30 wt.%.

(9) Niobium

Niobium has, similarly to vanadium, the function of producing carbide through combination with carbon, and thus improving creep strength. For the same reason as for vanadium, the niobium content should be limited within the range of from 0.005 to 0.200 wt.%.

Vanadium and niobium have the function of increasing creep strength as described above, and the simultaneous addition of vanadium and niobium makes the above-mentioned effect more remarkable.

Figure 2:
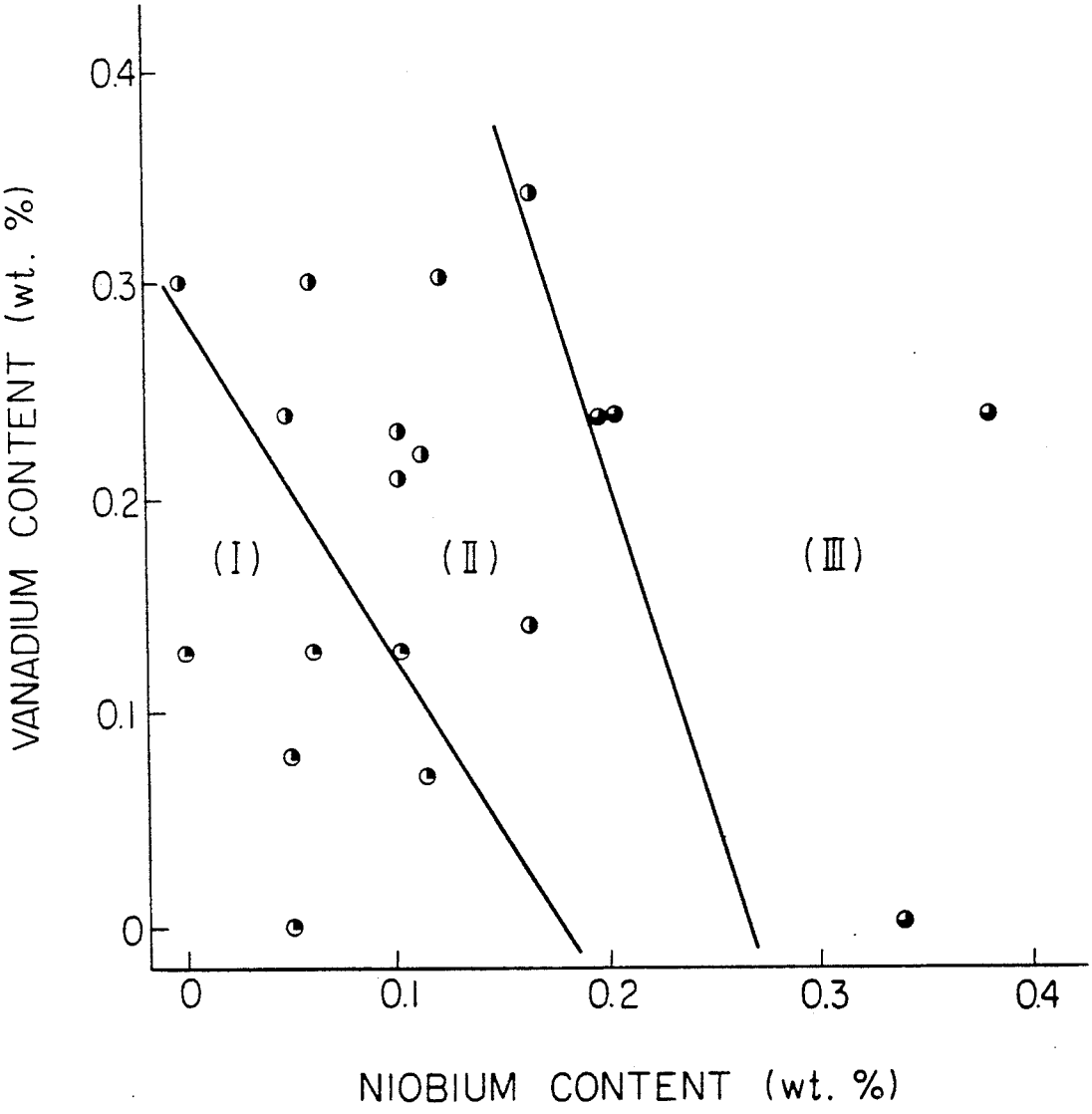
FIG. 2 is a graph illustrating the effect of the contents of vanadium and niobium on high-temperature cracking resistance in a welded joint.

However, the contents of vanadium and niobium largely affect high-temperature cracking resistance in the welded joint. We therefore investigated the effect of the contents of vanadium and niobium on high-temperature cracking resistance in the welded joint in accordance with the trans-varestraint test as described hereafter. The surfaces of the chromium steel test pieces each having a prescribed thickness, which have the different contents of vanadium and niobium and contain 0.05 wt.% carbon, 9 wt.% chromium and 1 wt.% molybdenum, were partly welded. The welded joints of the test pieces during welding were forcedly bent under a 1% augmented strain, and the total of high-temperature crack length produced in each of the welded joints was measured. The result of this test is illustrated in FIG. 2. In FIG. 2, plots "◔" represent the case with the total of high-temperature crack lengths of under 0.5 mm, plots "◑" represent the case with the total of high-temperature crack lengths of from 0.5 mm to under 1.0 mm, and plots "◕" represent the case with the total of high-temperature crack lengths of at least 1.0 mm. In FIG. 2, the region (I) confined by an oblique line shows a region in which the total of high-temperature crack lengths is under 0.5 mm; the region (II) confined by two oblique lines shows a region in which the total of high-temperature crack lengths is from 0.5 mm to under 1.0 mm; and the remaining region (III) shows a region in which the total of high-temperature crack lengths is at least 1.0 mm. The region (I) also includes the total of high-temperature crack lengths of under 0.5 mm of the above-mentioned SUS 304 austenitic stainless steel as specified in JIS, which poses no problem regarding high-temperature cracking resistance in the welded joint. In order to satisfy the conditions of the region (I), the total amount of vanadium and 1.5 times niobium should be up to 0.30 wt.%. Therefore, the total amount of vanadium and 1.5 times niobium should be limited up to 0.30 wt.%.

(10) Copper

Copper has the function of improving strength. In the steel of the present invention, therefore, copper is additionally and optionally added as required. However, with a copper content of under 0.01 wt.%, the desired effect as mentioned above cannot be obtained. With a copper content of over 0.50 wt.%, on the other hand, hot workability is deteriorated, and high-temperature cracking resistance in the welded joint decreases. Therefore, the copper content should be limited within the range of from 0.01 to 0.50 wt.%.

(11) Nickel

Nickel has the function of improving hardenability, and reducing the amount of ferrite in steel, thus improving toughness. In the steel of the present invention, therefore, nickel is additionally and optionally added as required. However, with a nickel content of under 0.01 wt.%, the desired effect as mentioned above cannot be obtained. With a nickel content of over 0.50 wt.%, on the other hand, hardness of the heat-affected zone near the welded joint increases excessively, thus leading to a lower low-temperature cracking resistance in the welded joint. Therefore, the nickel content should be limited within the range of from 0.01 to 0.50 wt.%.

(12) Boron

Boron has the function of improving hardenability. In the steel of the present invention, therefore, boron is additionally and optionally added as required. However, with a boron content of under 0.0003 wt.%, the desired effect as mentioned above cannot be obtained. With a boron content of over 0.0030 wt.%, on the other hand, high-temperature cracking resistance in the welded joint decreases. Therefore, the boron content should be limited within the range of from 0.0003 to 0.0030 wt.%.

(13) Titanium

Titanium has the function of producing carbide through combination with carbon, thus resulting in a higher creep strength, and when boron is added, of increasing the hardenability improving effect of boron. In the steel of the present invention, therefore, titanium is additionally and optionally added as required. However, with a titanium content of under 0.005 wt.%, the desired effect as mentioned above cannot be obtained. With a titanium content of over 0.030 wt.%, on the other hand, the increased amount of ferrite in steel deteriorates toughness. Therefore, the titanium content should be limited within the range of from 0.005 to 0.030 wt.%.

(14) Amount of ferrite ($\delta_F$) in steel

In the coarse grain zone of the heat-affected zone near the welded joint, there exists ferrite in an amount larger than in the base metal because ferrite is produced at high temperatures during welding. In addition, when a normalizing treatment is applied to a chromium steel plate having a thickness of 300 mm, for example, the chromium steel plate heated to a temperature of about 800° C. is then cooled up to a temperature of about 500°

C. at a slow cooling rate of about 2° C./min. This normalizing treatment causes $Ar_3$ transformation, thus leading to production of ferrite in steel. Ferrite causes deterioration of toughness. Therefore, the amount of ferrite ($\delta_F$) in steel as calculated by the following formula A or B should be limited to a number 5 or lower:

A. When the steel contains neither nickel nor boron as the additional and optional element:

$$\delta_F = -104 - 555\left(C + \frac{6}{7}N\right) + 32.9Si - 49.5Mn + 12.1Cr + 39.1Mo + 46.1V + 83.5Nb$$

B. When the steel contains at least one of nickel and boron as the additional and optional element:

$$\delta_F = -104 - 555\left(C + \frac{6}{7}N\right) + 32.9Si - 49.5Mn - 28.7Ni - 12.1Cr - 39.1Mo + 46.1V - 83.5Nb - 697B$$

Now, the steel of the present invention is described further in detail by means of an example in comparison with steels for comparison outside the scope of the present invention.

EXAMPLE

Test pieces of the steel of the present invention (hereinafter referred to as the "samples of the present invention") Nos. 1 to 9, having a chemical composition and an amount of ferrite ($\delta_F$) both within the scope of the present invention as shown in Table 3, were prepared. For comparison purposes, test pieces of steel for comparison (hereinafter referred to as the "samples for comparison") Nos. 1 to 4, having a chemical composition and an amount of ferrite ($\delta_F$) of which at least one was outside the scope of the present invention, were prepared. The samples for comparison Nos. 1 and 2 had the chemical composition and the amount of ferrite ($\delta_F$) both outside the scope of the present invention as shown in Table 3. The samples for comparison Nos. 3 and 4 had the chemical composition outside the scope of the present invention and the amount of ferrite ($\delta_F$) within the scope of the present invention as shown in Table 3. For reference purposes, the chemical composition of SUS304 austenitic stainless steel specified in JIS is also shown in Table 3.

Then, low-temperature cracking resistance in the welded joint ($Hv_{10max}$ and $yT_{stop}$ specified in JIS), high-temperature cracking resistance in the welded joint, and toughness in the base metal and the welded joint were investigated on the samples of the present Nos. 1 to 9 and the samples for comparison Nos. 1 to 4 by means of various tests as described hereafter. The results of these tests are shown in Table 4.

TABLE 3

| No. | | Thickness (mm) | chemical composition (wt. %) C | Si | Mn | P | S | Cu | Ni | Cr | Mo | V |
|---|---|---|---|---|---|---|---|---|---|---|---|---|
| Samples of the present invention | 1 | 20 | 0.07 | 0.31 | 0.51 | 0.003 | 0.005 | — | — | 8.30 | 1.05 | 0.21 |
| | 2 | 30 | 0.06 | 0.30 | 0.55 | 0.005 | 0.002 | — | 0.05 | 8.16 | 0.95 | 0.16 |
| | 3 | 50 | 0.06 | 0.29 | 0.56 | 0.002 | 0.003 | — | 0.10 | 8.05 | 1.03 | 0.17 |
| | 4 | 300 | 0.08 | 0.22 | 0.60 | 0.005 | 0.001 | — | 0.08 | 8.32 | 0.96 | 0.22 |
| | 5 | 250 | 0.07 | 0.23 | 0.55 | 0.008 | 0.001 | 0.43 | — | 8.22 | 1.01 | 0.21 |
| | 6 | 250 | 0.07 | 0.10 | 0.62 | 0.007 | 0.001 | — | — | 7.05 | 1.06 | 0.23 |
| | 7 | 50 | 0.09 | 0.05 | 0.55 | 0.002 | 0.002 | — | — | 9.01 | 1.25 | 0.28 |
| | 8 | 50 | 0.09 | 0.35 | 0.66 | 0.009 | 0.001 | — | 0.45 | 8.98 | 1.11 | — |
| | 9 | 250 | 0.05 | 0.05 | 1.35 | 0.011 | 0.001 | — | — | 8.16 | 0.77 | 0.22 |
| Samples for comparison | 1 | 50 | 0.07 | 0.28 | 0.62 | 0.006 | 0.005 | — | — | 8.85 | 2.24 | — |
| | 2 | 15 | 0.09 | 0.35 | 0.54 | 0.008 | 0.006 | — | — | 9.29 | 1.07 | 0.17 |
| | 3 | 15 | 0.10 | 0.39 | 0.38 | 0.002 | 0.006 | — | — | 8.30 | 0.93 | 0.21 |
| | 4 | 15 | 0.10 | 0.33 | 0.52 | 0.009 | 0.004 | — | — | 8.97 | 1.05 | — |
| SUS 304 | | 15 | 0.05 | 0.62 | 1.79 | 0.022 | 0.011 | — | 8.87 | 18.75 | 0.11 | — |

| No. | | chemical composition (wt. %) Nb | Ti | B | N | Sol.Al | Amount of ferrite ($\delta_F$) (wt. %) |
|---|---|---|---|---|---|---|---|
| Samples of the present invention | 1 | 0.05 | 0.012 | 0.0009 | 0.0122 | 0.016 | −8.8 |
| | 2 | 0.06 | — | — | 0.0116 | 0.014 | −12.9 |
| | 3 | 0.08 | — | — | 0.0119 | 0.016 | −11.9 |
| | 4 | 0.04 | — | — | 0.0139 | 0.015 | −28.2 |
| | 5 | 0.05 | — | — | 0.0129 | 0.021 | −17.1 |
| | 6 | 0.03 | — | — | 0.0144 | 0.026 | −33.8 |
| | 7 | — | 0.022 | — | 0.0295 | 0.033 | −22.8 |
| | 8 | 0.11 | 0.007 | 0.0011 | 0.0330 | 0.026 | −43.2 |
| | 9 | 0.04 | — | 0.0015 | 0.0048 | 0.022 | −56.5 |
| Samples for comparison | 1 | — | — | — | 0.0141 | 0.016 | 23.7 |
| | 2 | 0.21 | — | — | 0.0102 | 0.011 | 6.4 |
| | 3 | 0.08 | — | — | 0.0329 | 0.014 | −30.0 |
| | 4 | — | — | — | — | — | −29.6 |
| SUS 304 | | — | — | — | 0.0170 | — | — |

TABLE 4

| No. | | Low-temperature cracking resistance $Hv_{10max}$ | $yT_{stop}$ (°C.) | High-temperature cracking resistance: Total of high-temp. crack lengths under 1% augmented strain (mm) | Toughness ($vE_o$): Base metal (Kg · f · m) | Toughness ($vE_o$): Welded joint (Kg · f · m) |
|---|---|---|---|---|---|---|
| Samples of the present invention | 1 | 350 | 100 | 0.1 | >30 | 26.9 |
| | 2 | 335 | 100 | 0.3 | >30 | 24.8 |
| | 3 | 330 | 100 | 0.1 | >30 | 27.4 |
| | 4 | 385 | 150 | 0.3 | 17.5 | 29.2 |
| | 5 | 346 | 100 | 0.5 | 21.2 | 25.1 |
| | 6 | 360 | 100 | 0.1 | 20.5 | 27.2 |
| | 7 | 371 | 150 | 0.5 | >30 | 20.5 |
| | 8 | 377 | 150 | 0.7 | >30 | 21.1 |
| | 9 | 322 | 100 | 0.3 | 24.4 | 21.7 |
| Samples for comparison | 1 | 331 | 100 | 0 | 16.4 | 3.4 |
| | 2 | 376 | 150 | 3.1 | 20.2 | 6.5 |
| | 3 | 433 | 150 | 2.4 | >30 | 17.4 |
| | 4 | 429 | 150 | 1.5 | 15.5 | 10.6 |

(1) Low-temperature cracking resistance ($Hv_{10max}$)

Low-temperature cracking resistance ($Hv_{10max}$) in the welded joint was measured by means of the maximum hardness test as specified in JIS Z3101, which comprises: partly welding the surface of a sample under prescribed conditions, and then measuring the maximum value of hardness in the welding-heat-affected zone by means of the Vickers hardness test under a load of 10 kg.

(2) Low-temperature cracking resistance ($yT_{stop}$)

Low-temperature cracking resistance ($yT_{stop}$) in the welded joint was measured by means of the y-slit crack test as specified in JIS Z3158, which comprises: forming a diagonal y-shaped groove in a sample, preheating the sample having the thus formed groove at various temperatures, welding the groove under prescribed conditions, and determining the preheating temperature at which a root crack is not produced. For this test, samples each having a thickness of 50mm were used for the samples of the present invention Nos. 4, 5, 6 and 9.

(3) High-temperature cracking resistance

High-temperature cracking resistance in the welded joint was measured by the trans-varestraint test, which comprises: partly welding the surface of a sample having a thickness of 8 mm under the following conditions, forcedly bending the welded joint of the sample during welding under a 1% augmented strain, and measuring the total of high-temperature crack lengths produced in the welded joint:

| | |
|---|---|
| Welding method: | gas-tungsten arc welding (GTAW), |
| Welding current: | 150 A, |
| Arc voltage: | 15 V, |
| Welding speed: | 7 cm/minute. |

(4) Toughness ($vE_o$)

Toughness of the base metal and the welded joint was measured by means of the impact test which comprises: partly welding the surface of a sample under the following conditions, forming a V-shaped notch on each of the base metal and the welding-heat-affected zone 2 mm apart from the weld junction line, and measuring an impact value at 0° C. for each of the base metal and the welding-heat-affected zone:

| | |
|---|---|
| Welding method: | gas-tungsten arc welding (GTAW), |
| Welding wire: | with the same chemical composition as that of base metal. |
| Preheating temperature and interpass temperature of sample: | 150° C., |
| Welding heat input: | 14.4 kJ/cm. |
| Heat treatment temperature after welding: | 710° C. |
| Heat treatment time after welding: | 8.5 hr. |

As is evident from Tables 3 and 4, the sample for comparison No. 1, which has a high molybdenum content outside the scope of the present invention, contains neither vanadium nor niobium, and has a large amount of ferrite ($\delta_F$) in steel outside the scope of the present invention, shows a poor toughness in the welded joint. The sample for comparison No. 2 having a high chromium content, a large total amount of vanadium and 1.5 times niobium, and a large amount of ferrite ($\delta_F$) in steel, all of which are outside the scope of the present invention, shows a low high-temperature cracking resistance and a low toughness in the welded joint.

The sample for comparison No. 3 having a high carbon content and a large total amount of vanadium and 1.5 times niobium, both of which are outside the scope of the present invention, shows a low low-temperature cracking resistance ($Hv_{10}max$) and a low high-temperature cracking resistance in the welded joint. The sample for comparison No. 4, which has a high carbon content outside the scope of the present invention, and contains neither vanadium nor niobium, shows a low low-temperature cracking resistance ($Hv_{10max}$) and a low high-temperature cracking resistance in the welded joint.

All the samples of the present invention Nos. 1 to 9 show, in contrast, a high low-temperature cracking resistance ($Hv_{10max}$ and $yT_{stop}$), a high high-temperature cracking resistance and a high toughness in the welded joint.

Then, creep strength in the welded joint was investigated on the samples of the present invention and the samples for comparison.

Figure 3:
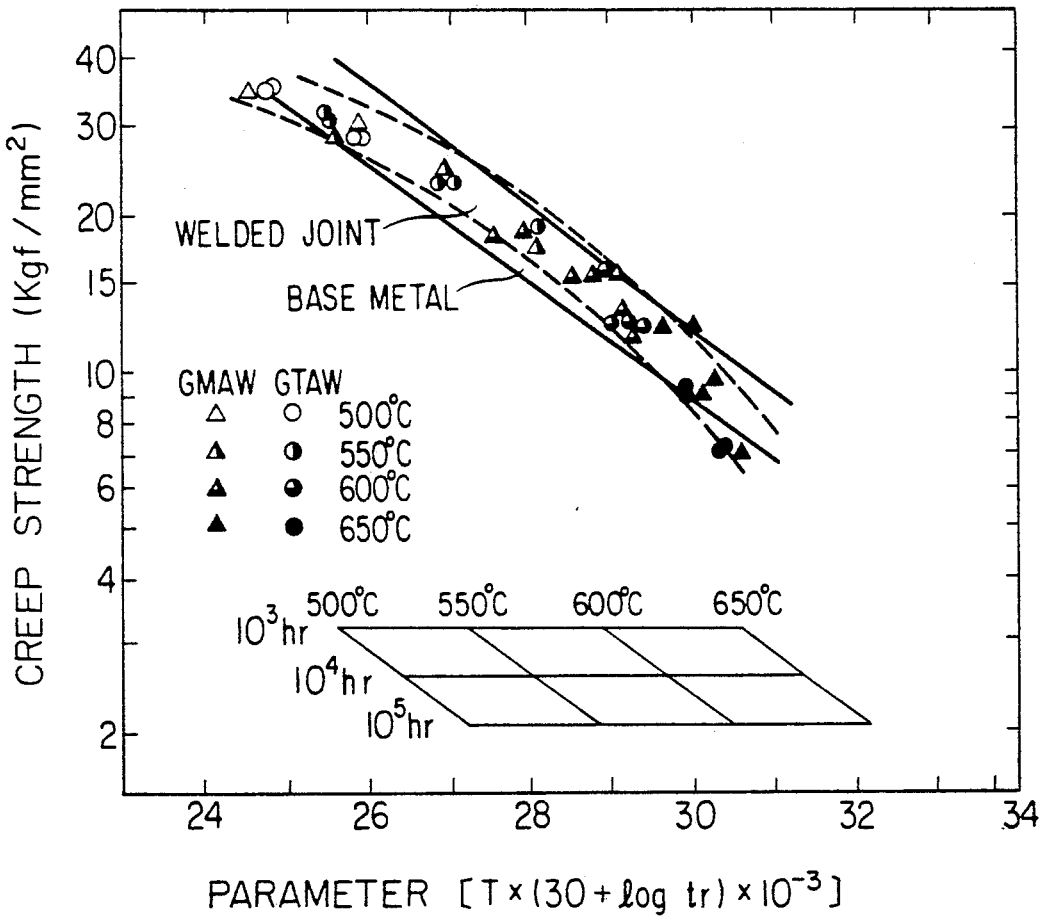
FIG. 3 is a graph illustrating creep strength in a welded joint of a test piece of the steel of the present invention.

FIG. 3 is a graph illustrating values of creep strength in the welded joint of the samples of the present invention Nos. 1, 3 and 4. In FIG. 3, the triangular plots represent values of creep strength in the welded joint for the samples of the present invention, which are welded by the gas-metal arc welding (GMAW), and the circular plots represent values of creep strength in the welded joint for the samples of the present invention, which are welded by the gas-tungsten arc welding (GTAW). In FIG. 3, the plots "Δ" and "O" represent the case with a creep test temperature of 500° C.; the plots "◭" and "◑" a creep test temperature of 550° C.; the plots "◭" and "◕", a creep test temperature of 600° C.; and the plots "▲" and "●", a creep test temperature of 650° C. In FIG. 3, the region confined by two solid lines represents values of creep strength in the base metal of the samples of the present invention, and the region confined by two dotted lines represents values of creep strength in the welded joint of the samples of the present invention.

Figure 4:
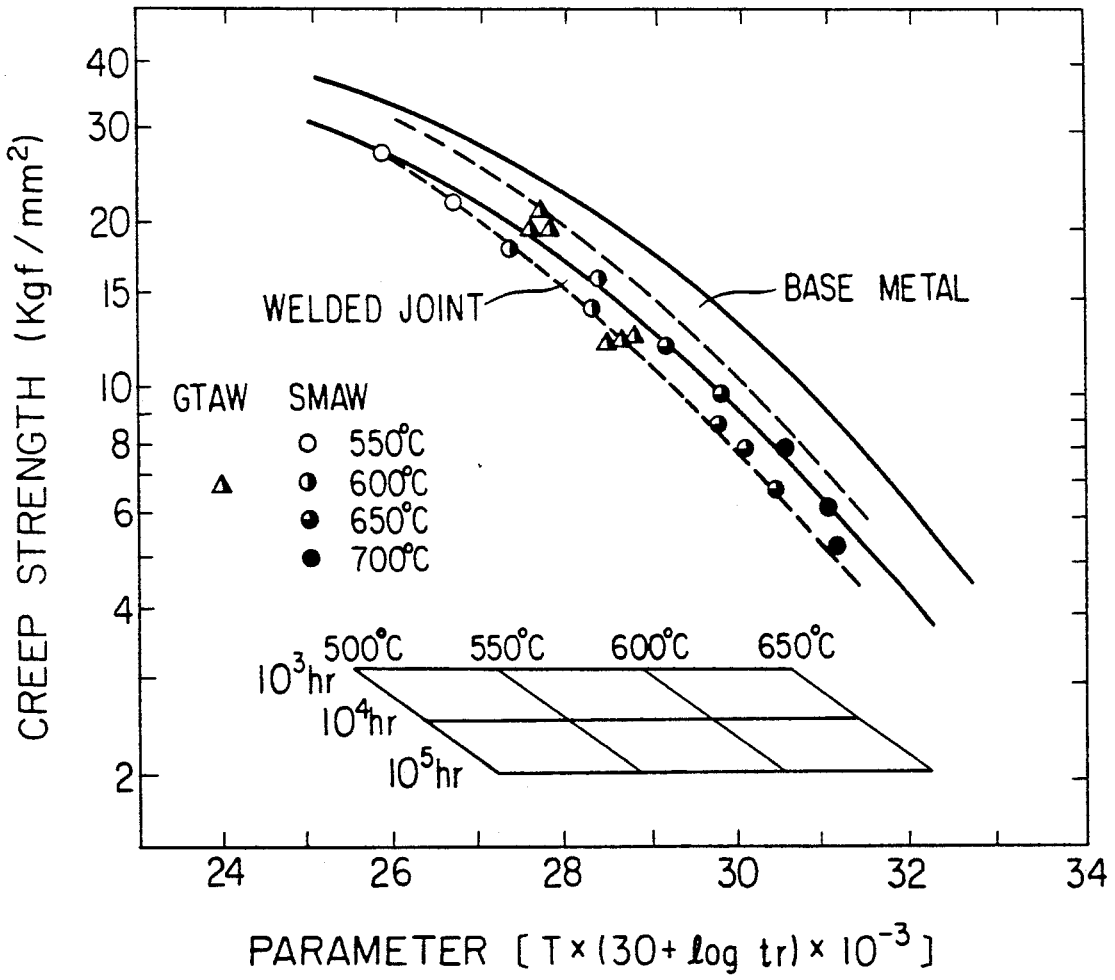
FIG. 4 is a graph illustrating creep strength in a welded joint of a test piece of steel for comparison outside the scope of the present invention.

FIG. 4 is a graph illustrating values of creep strength in the welded joint of the sample for comparison No. 1. In FIG. 4, the triangular plots represent values of creep strength in the welded joint for the samples for comparison, which are welded by the gas-tungsten arc welding (GTAW), and the circular plots represent values of creep strength in the welded joint for the samples for comparison, which are welded by the shielded metal arc welding (SMAW). In FIG. 4, the plots " " represent the case with a creep test temperature of 550° C.; the plots "◭"and "◑", a creep test temperature of 600° C.; the plots "◕", a creep test temperature of 650° C.; and the plots "●", a creep test temperature of 700° C. In FIG. 4, the region confined by two solid lines represents values of creep strength in the base metal of the samples for comparison, and the region confined by two dotted lines represents values of creep strength in the welded joint of the samples for comparison.

In FIGS. 3 and 4, the abscissa indicates a parameter comprehensively expressing the creep test temperature (T) and the creep rupture time (tr) by means of a formula: $[T\times(30+\log tr)\times 10^{-3}]$; and the ordinate indicates values of creep strength. The rhombic frame shown in FIGS. 3 and 4 is a graph for determining the parameter described above from the creep test temperature and the creep rupture time.

As shown in FIG. 3, almost all the values of creep strength in the welded joint of the samples of the present invention Nos. 1, 3 and 4 are within the region confined by two solid lines, which represents values of creep strength in the base metal, i.e., are on the same level as those in the base metal. Although not shown in FIG. 3, the other samples of the present invention Nos. 2 and 5 to 9 also showed the tendencies similar to those in the samples of the present invention Nos. 1, 3 and 4 described above.

As shown in FIG. 4, in contrast, almost all the values of creep strength in the welded joint of the sample for comparison No. 1 are on or below the lower limit of the region confined by two solid lines, which represents values of creep strength in the base metal, i.e., are lower than those in the base metal, In addition, in the temperature range of from 500° to 550° C., which corresponds to the temperature range of the superheater of the steam generator, values of creep strength in the welded joint of the sample for comparison No. 1 are lower than those in the welded joint of the samples of the present invention Nos. 1, 3 and 4. Although not shown in FIG. 4, the other samples for comparison Nos. 2 to 4 also snowed the tendencies similar to those in the sample for comparison No. 1 described above.

As described above in detail, the chromium heat-resistant steel of the present invention is excellent in toughness, has a high cracking resistance and a high creep strength in the welded joint, is particularly suitable to be used as a material for the steam generator of the nuclear power plant based on the fast breeder reactor, and permits reduction of the construction cost thereof, thus providing many industrially useful effects.

What is claimed is:

1. A chromium heat-resistant steel having excellent toughness and having high cracking resistance and high creep strength when said steel is utilized to form a welded joint, said steel consisting essentially of:

| | |
|---|---|
| carbon: | from 0.04 to 0.09 wt. %, |
| silicon: | from 0.01 to 0.50 wt. %, |
| manganese: | from 0.25 to 1.50 wt. %, |
| chromium: | from 7.0 to 9.2 wt. %, |
| molybdenum: | from 0.50 to 1.50 wt. %, |
| soluble aluminum: | from 0.005 to 0.060 wt. %, |
| nitrogen: | from 0.001 to 0.060 wt. %, |

the total amount of said nitrogen and said carbon being up to 0.13 wt.%, at least one element selected from the group consisting of:

| | |
|---|---|
| vanadium: | from 0.01 to 0.30 wt. %, |
| and | |
| niobium: | from 0.005 to 0.200 wt. %, |

the total amount of said vanadium and 1.5 times said niobium being no more than 0.30 wt.%, and the balance being iron and incidental impurities; and the amount of ferrite as represented by the ferrite number δF in said chromium heat-resistant steel being −5 or lower, as calculated by the following formula:

$$\delta_F = -104-555(C+6/7N)+32.9Si-49.5Mn+12.1Cr+39.1Mo+46.1V+83.5Nb.$$

2. A chromium heat-resistant steel having excellent toughness and having high cracking resistance and high creep strength when said steel is utilized to form a welded joint, said steel consisting essentially of:

| | |
|---|---|
| carbon: | from 0.04 to 0.09 wt. %, |
| silicon: | from 0.01 to 0.50 wt. %, |
| manganese: | from 0.25 to 1.50 wt. %, |
| chromium: | from 7.0 to 9.2 wt. %, |
| molybdenum: | from 0.50 to 1.50 wt. %, |
| soluble aluminum: | from 0.005 to 0.060 wt. %, |
| nitrogen: | from 0.001 to 0.060 wt. %, |

the total amount of said nitrogen and said carbon being up to 0.13 wt.%, at least one element selected from the group consisting of:

| | |
|---|---|
| vanadium: | from 0.01 to 0.30 wt. %, |
| and | |
| niobium: | from 0.005 to 0.200 wt. %, |

the total amount of said vanadium and 1.5 times said niobium being no more than 0.30 wt.%, at least one element selected from the group consisting of:

| | |
|---|---|
| copper: | from 0.01 to 0.50 wt. %, |
| nickel: | from 0.01 to 0.50 wt. %, |

-continued

| | |
|---|---|
| boron: | from 0.0003 to 0.0030 wt. %, |
| and titanium: | from 0.005 to 0.030 wt. %, |

and the balance being iron and incidental impurities; and the amount of ferrite as represented by the ferrite number δF in said chromium heat-resistant steel being −5 or lower, as calculated by the following formula:

$$\delta_F = -104 - 555\left(C + \frac{6}{7}N\right) + 32.9Si - 49.5Mn - 28.7Ni + 12.1Cr + 39.1Mo + 46.1V + 83.5Nb - 697B.$$

3. The steel of claim 2 consisting essentially of, in weight %, 0.07 C, 0.31 Si, 0.51 Mn, 0.003 P, 0.005 S, 8.30 Cr, 1.05 Mo, 0.21 V, 0.05 Nb, 0.012 Ti, 0.009 B, 0.0122 N and 0.016 Sol.Al.

4. The steel of claim 2 consisting essentially of, in weight %, 0.06 C, 0.30 Si, 0.55 Mn, 0.005 P, 0.002 S, 0.05 Ni, 8.16 Cr, 0.95 Mo, 0.16 V, 0.06 Nb, 0.116 N and 0.014 Sol.Al.

5. The steel of claim 2 consisting essentially of, in weight %, 0.06 C, 0.29 Si, 0.56 Mn, 0.002 P, 0.003S, 0.10 Ni, 8.05 Cr, 1.03 Mo, 0.17 V, 0.08 Nb, 0.119 N and 0.016 Sol.Al.

6. The steel of claim 2 consisting essentially of, in weight %, 0.08 C, 0.22 Si, 0.60 Mn, 0.005 P, 0.001 S, 0.08 Ni, 8.32 Cr, 0.96 Mo, 0.22 V, 0.04 Nb, 0.0139 N and 0.015 Sol.Al.

7. The steel of claim 2 consisting essentially of, in weight %, 0.07 C, 0.23 Si, 0.55 Mn, 0.008 P, 0.001 S, 0.43 Cu, 8.22 Cr, 1.01 Mo, 0.21 V, 0.05 Nb, 0.0129 N and 0.021 Sol.Al.

8. The steel of claim 2 consisting essentially of, in weight %, 0.07 C, 0.10 Si, 0.62 Mn, 0.007 P, 0.001 S, 7.05 Cr, 1.06 Mo, 0.23 V, 0.03 Nb, 0.0144 N and 0.026 Sol.Al.

9. The steel of claim 2 consisting essentially of, in weight %, 0.09 C, 0.05 Si, 0.55 Mn, 0.002 P, 0.002 S, 9.01 Cr, 1.25 Mo, 0.28 V, 0.22 Ti, 0.295 N and 0.033 Sol.Al.

10. The steel of claim 2 consisting essentially of, in weight %, 0.09 C, 0.35 Si, 0.66 Mn, 0.009 P, 0.001 S, 0.45 Ni, 8.98 Cr, 1.11 Mo, 0.11 Nb, 0.007 Ti, 0.0011 B, 0.0330 N and 0.026 Sol.Al.

11. The steel of claim 2 consisting essentially of, in weight %, 0.05 C, 0.05 Si, 1.35 Mn, 0.011 P, 0.001 S, 8.16 Cr, 0.77 Mo, 0.22 V, 0.04 Nb, 0.0015 B, 0.0048 N and 0.022 Sol.Al.

* * * * *